US005433434A

United States Patent [19]

Helmetsie

[11] Patent Number: 5,433,434

[45] Date of Patent: Jul. 18, 1995

[54] BASEBALL PITCHING TARGET

[76] Inventor: Eugene A. Helmetsie, 939 S. Danby Rd., Ithaca, N.Y. 14883

[21] Appl. No.: 368,431

[22] Filed: Jan. 4, 1995

[51] Int. Cl.[6] ..... A63B 69/00

[52] U.S. Cl. ..... 273/26 A

[58] Field of Search ..... 273/26 A

[56] References Cited

U.S. PATENT DOCUMENTS

| | | | |
|---|---|---|---|
| 1,592,005 | 7/1926 | Rovane | 273/26 A |
| 1,879,316 | 9/1932 | Kleb | 273/26 A |
| 2,059,365 | 11/1936 | King | 273/26 A |
| 2,126,102 | 8/1938 | Fowler | 273/26 A |
| 2,254,986 | 9/1941 | Ziel | 273/26 A |
| 2,873,969 | 2/1959 | Ziel | 273/26 A |
| 3,195,898 | 7/1965 | Respini | 273/26 A |
| 3,312,467 | 4/1967 | Dawson | 273/26 A |
| 3,633,909 | 1/1972 | Doynow | 273/26 A |
| 3,658,329 | 4/1972 | Ciccarello | 273/26 A |
| 3,997,158 | 12/1976 | Britton | 273/26 A |
| 4,210,326 | 7/1980 | Booth et al. | 273/26 A |
| 4,254,952 | 3/1981 | Playter, Jr. | 273/26 A |
| 4,473,227 | 9/1984 | Klaus | 273/26 A |
| 4,629,188 | 12/1986 | Mahieu | 273/26 A |
| 4,657,250 | 4/1987 | Newland et al. | 273/26 A |
| 4,718,668 | 1/1988 | Schiepske | 273/26 A X |
| 4,781,376 | 11/1988 | Barnes, Sr. | 273/26 A |
| 4,783,070 | 11/1988 | Bauer et al. | 273/26 A |
| 5,230,505 | 7/1993 | Paquet et al. | 273/26 A |
| 5,348,291 | 9/1994 | Scully | 273/26 A |

*Primary Examiner*—William H. Grieb

*Attorney, Agent, or Firm*—Barnard, Brown & Michaels

[57] ABSTRACT

A pitching, throwing or kicking training device having a support frame, a strike zone frame which is fully adjustable in height and positionable within the support frame, and a catcher target behind the strike zone frame which is adjustable in height and position. A simulated batter is provided to aid in visualization of the strike zone, adjustable in height and reversible to simulate right- or left-handed batters. The strike zone frame may also be distorted into non-rectangular parallelograms if desired to emphasize pitching techniques. The invention is also adaptable to training lacrosse or soccer players or the like by appropriate choice of strike zone frame size and position and possibly change of player silhouette.

15 Claims, 4 Drawing Sheets

BASEBALL PITCHING TARGET

FIELD OF THE INVENTION

The invention pertains to the field of sports training equipment. More particularly, the invention pertains to training and practice equipment for perfecting throwing skills, particularly applicable to the game of baseball, although it is also useful in other games requiring accuracy in ball handling such as lacrosse or soccer or the like.

BACKGROUND OF THE INVENTION

Baseball is played on an area divided into an infield of standard proportions and an outfield of varied dimensions. The infield is square, with 90 ft on each side. The corner farthest from the outfield fence is home plate, and the other bases—first, second, and third—run counterclockwise. The pitcher's mound, an 18-ft circle inclining upward toward a small rectangular robber slab in the center, lies inside the square 60 ft 6 in. from home plate.

The team at bat sends its nine men to the plate in a specified sequence. Each batter attempts to hit the pitcher's deliveries, which the latter tries to vary in speed and in placement within the strike zone (the area over home plate and between the batter's knees and armpits). Throws which cross the plate outside the strike zone are not desirable, as they count as "balls" if the player does not swing at them.

It is thus important that the pitcher be able to throw the ball within the limits of the strike zone, while being able to vary the speed and placement within those limits. This accuracy requires practice to attain, especially for young players, who must contend with the combination of lesser inherent coordination and a smaller strike zone. The pitcher can simply practice with a catcher, but must then envision an abstract strike zone for the hypothetical batter.

In training a player to throw accurately, a coach will not only want him to practice throwing at a specific point, but to practice placing the ball at various spots within the strike zone. The coach may want to force the pitcher to adapt to the real-life problems of differently sized players, right-/left-handed batters, etc. by changing the size and location of the simulated strike zone and the simulated catcher's mitt/target.

A number of pitching targets have been previously patented. These include the following.

Rovane, U.S. Pat. No. 1,592,005, shows a pitching practice guide comprising a pair of upright posts supporting a pair of cross-posts, which define a strike zone simulation. There is no central target for the pitcher to aim at, and the cross-posts are not easily adjustable. The shape of the strike zone is fixed. There is no simulated batter.

Kleb, U.S. Pat. No. 1,879,316, shows a baseball strike zone target which is defined by colors on a number of ropes suspending an iron plate. A smaller ball target is also supplied, independent of the strike zone, adjustable in height by the pitcher by moving ropes extending out to the mound. A gutter returns balls which hit a flat canvas backstop. The strike zone and ball targets are not related, the strike zone is not adjustable, there is no simulated batter.

Fowler, U.S. Pat. No. 2,126,102, shows a pitching target in front of a backstop cage. The strike zone is a rectangle subdivided by diagonals to define multiple areas. The size of the strike zone is not adjustable. There is no separate catcher target.

Ziel, U.S. Pat. No. 2,254,986, shows a target in the form of a suspended canvas sheet with a batter and catcher drawn on it. A hole in the center of the catcher's mitt forms a target, as well as four others for inside and outside high and low balls. The targets (being holes) are not adjustable in size or location, and them is no strike zone.

Respini, U.S. Pat. No. 3,195,898, shows a mesh backstop with a target (circles) imprinted upon it. The target is not adjustable, there is no strike zone or simulated batter.

Ciccarello, U.S. Pat. No. 3,658,329, shows a swinging rigid strike zone supported by a simulated batter. The strike zone is not adjustable in size or location and there is no separate catcher target.

Britton, U.S. Pat. No. 3,997,158, shows a strike zone target made of chains which can be suspended in front of a backstop. The size of the strike zone is not adjustable (additional chains may be added to define other zones), and there is no catcher target or simulated batter.

Playter, U.S. Pat. No. 4,254,952, shows a pitching practice device in the form of a sheet of canvas with a rectangular strike zone window subdivided into a number of sections. The strike zone (window) is not adjustable in size or location. There is no catcher target or simulated batter.

Newland, U.S. Pat. No. 4,657,250, shows a pitching practice device having a yielding strike zone target which allows the ball to pass through the target into a photoelectric detector. The strike zone is not adjustable in size or location. There is no separate catcher target.

Paquet, et. al., U.S. Pat. No. 5,230,505 shows another electronic pitch analyzer which can detect the speed and location of the ball as it passes through the sensor. There is a solid target zone behind the sensors which is not adjustable in size or location.

SUMMARY OF THE INVENTION

The invention presents a pitching training device having a support frame, a strike zone frame which is fully adjustable in height and positionable within the support frame, and a catcher target behind the strike zone frame which is adjustable in height and position. A simulated batter is provided to aid in visualization of the strike zone, adjustable in height and reversible to simulate right- or left-handed batters. The strike zone frame may also be distorted into non-rectangular parallelograms if desired to emphasize pitching techniques. The invention is also adaptable to lacrosse or soccer training or the like by appropriate choice of strike zone frame size and position and change of player silhouette.

DESCRIPTION OF THE PREFERRED EMBODIMENT

In the following discussion of the figures, identical reference numbers from figure to figure refer to identical elements. Only those elements specifically needed in understanding a given figure will be mentioned in the discussion.

Figure 1:
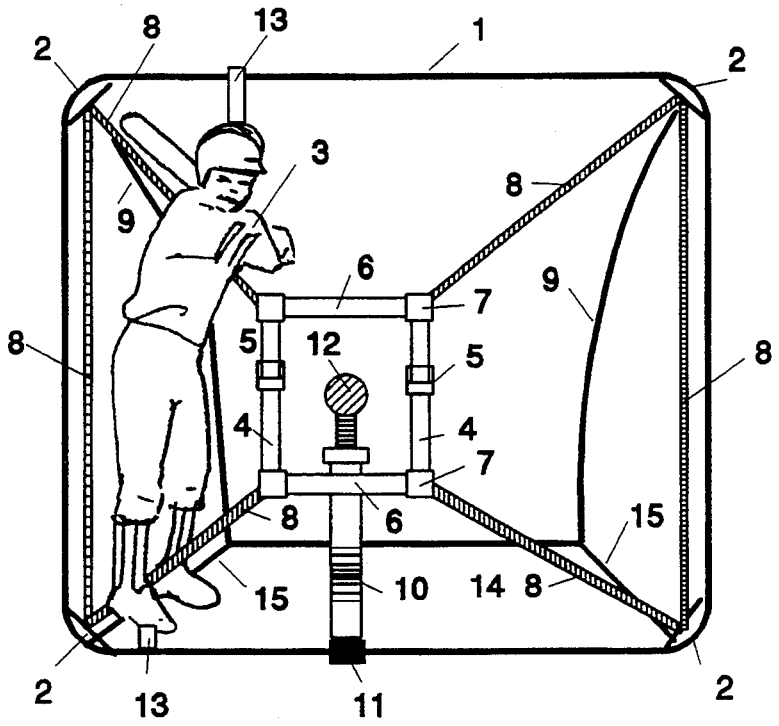
FIG. 1 shows a front view of the invention.
Figure 2:
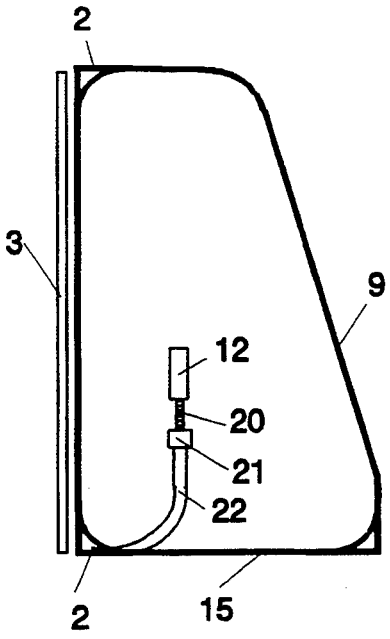
FIG. 2 shows a side view of the invention.

FIGS. 1 and 2 show the preferred embodiment of the invention in front and side view, respectively. The apparatus of the invention is surrounded and supported by a support frame (1), which is made up of tubing connected by corner blocks (2). Details of the corner block design will be discussed with FIG. 6, below. The support frame is held vertical by lower members (15) extending to the rear, and by rear brace members (9), connected to the lower members (15) by additional corner blocks (2). The exact design of the lower members (15) and rear brace members (9) is not critical, so long as they are capable of supporting the support frame (1) against hits by mis-aimed balls.

The support frame can be made of any suitable material which will be sufficiently strong to withstand hits by errant balls, yet be light enough to transport. Polyvinyl Chloride (PVC) pipe of approximately 1¼' diameter has been found to be especially appropriate for this use.

The support frame can be any appropriate size, so long as it is large enough to surround and support the simulated player and the targets. A size of approximately 6 feet high by 6 feet wide has been found to be ideal for the application. The lower members (15) would be about 3 feet long to adequately support a 6 by 6 foot support frame.

Figure 6:
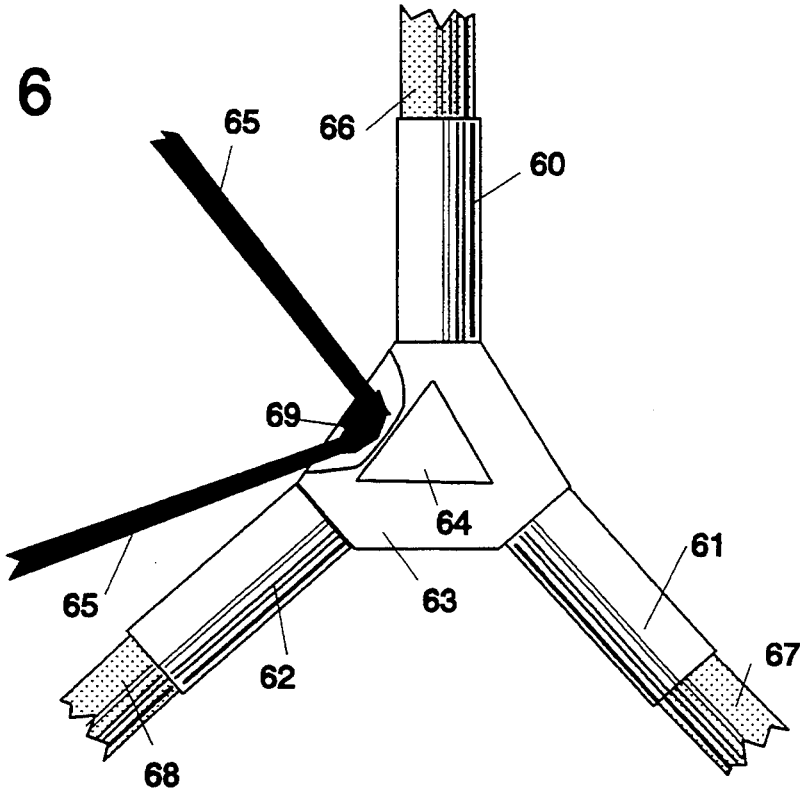
FIG. 6 shows a detail of a corner block used in the preferred embodiment of the invention.

FIG. 6 shows a detail of a corner block which is especially useful in this application. The body (63) of the corner block is roughly triangular in form, with truncated corners. The center (64) may be hollow, as shown, or solid. The truncated corners are fitted with extensions (60), which are adapted to fit solidly with the support frame, lower members, or rear brace members (66)(67) and (68) which attach to them. Preferably, this is done by cutting down the diameter of the extensions (60) at a point along their length so that they fit inside the tubing used for the frame. The corner block is preferably molded from polyethylene material, or a similar plastic, for strength combined with light weight. If it is desired to weld up the corner blocks from metal, the extensions (60) could be swaged out to fit over the frame members.

The corner block body (63) preferably has a triangular cleat (69) around which a supporting cord (65) can be routed. The cleat is mushroom shaped (i.e. wider on the outside than where it attaches to the body of the corner block, with a smooth shaft) to retain the supporting cord (65) at the corner block while allowing it to slide freely. A pulley could be provided at the corner block instead of the cleat, but the cleat arrangement allows the elastic supporting cord to be easily stretched to and removed from the corner blocks to assemble and disassemble the apparatus.

A strike zone frame is suspended within the support frame (1). The strike zone frame is made up of two side straps (4) and two horizontal straps (6) which are wide enough and of sufficient visual contrast to be easily seen from the pitcher's position (approximately 60½ feet, for standard baseball). The strap material should be strong enough to withstand hits by baseballs, and flexible enough to make adjustment easy. Polypropylene/Nylon webbing material, or a similar material, has been found to be preferred for this application.

The horizontal straps (6) can be fixed in width, as shown, at approximately 17 inches for a standard width baseball strike zone. The vertical straps (4) are widely adjustable in height through the use of buckles (5), through a range which can simulate the full range of possible strike zones (knee-to-shoulder distance) from smaller Little Leaguers through six-foot plus adults. A range of 21½ inches to 28 inches has been found to be adequate for this purpose. The side straps (4) and horizontal straps (6) are connected by strike zone frame corner elements (7), which provide attachment points for the supporting cords (8) which suspend the strike zone frame.

There are two supporting cords (8), one on each side of the strike zone frame. The supporting cords (8) are fixed at each end to the upper and lower strike zone corner elements (7) on each side, and slide freely where they pass through each corner block (2). This allows the strike frame to be easily adjusted, making fine adjustments in height by sliding the supporting cords (8) through the corner blocks (2).

Figure 4:
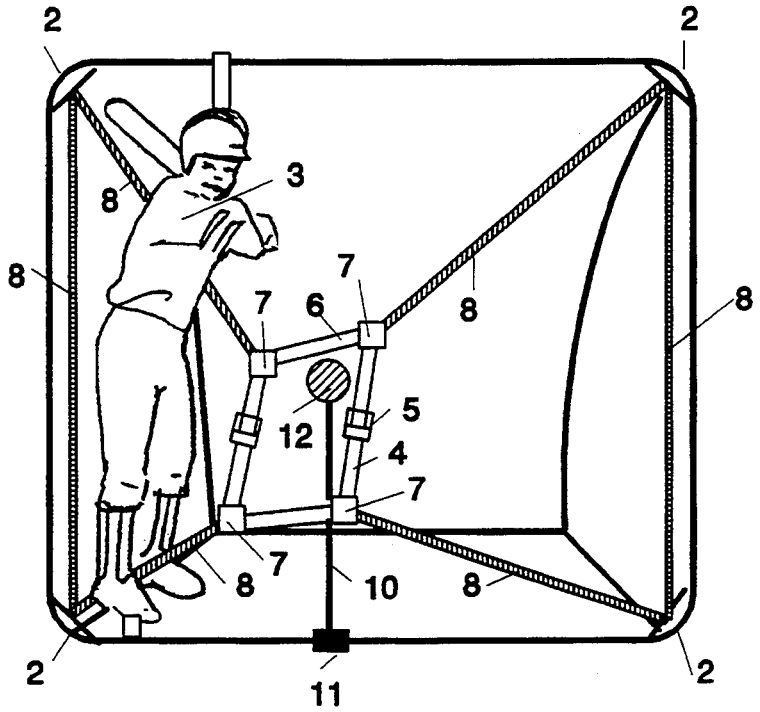
FIG. 4 shows a front view of the invention, with the strike zone frame distorted into a parallelogram.

By sliding the supporting cords unevenly, so that one side is raised more than the other, the strike zone frame may be distorted in shape into a parallelogram (see FIG. 4). A coach might wish to distort the strike zone this way in order to emphasize pitching to a given corner of the zone.

The preferred material for the supporting cords (8) is the nylon-covered elastic cord material commonly known as "shock cord" or "bungee cord". Five-sixteenth inch diameter cord, made by William M. Jette, of Providence, R.I., has been used in the invention. The supporting cords should be slightly shorter than the actual distance from the upper strike zone corner element to the upper corner block to the lower corner block to the lower strike zone corner element when the strike zone frame is at its horizontal position which is most distant from the side to which the cord is attached, so that the strike zone frame is normally under slight tension. The elastic nature of the supporting cord material then allows the strike zone frame to be moved from side-to-side by stretching the cords on one side more than the other. This effect can be seen by comparing the position of the strike zone frame in FIG. 1 to that in FIG. 3.

Figure 3:
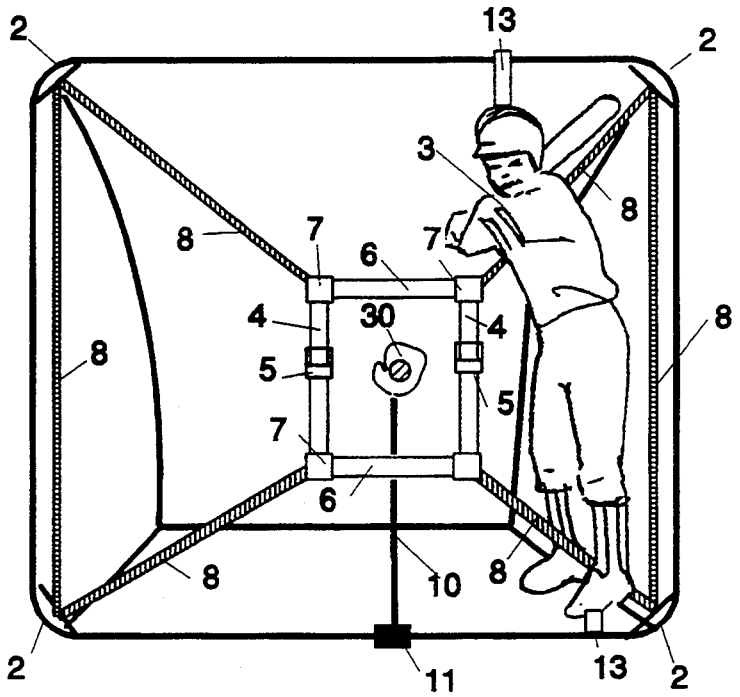
FIG. 3 shows a front view of the invention, configured for a right-handed batter, and with an alternative catcher target.
Figure 5:
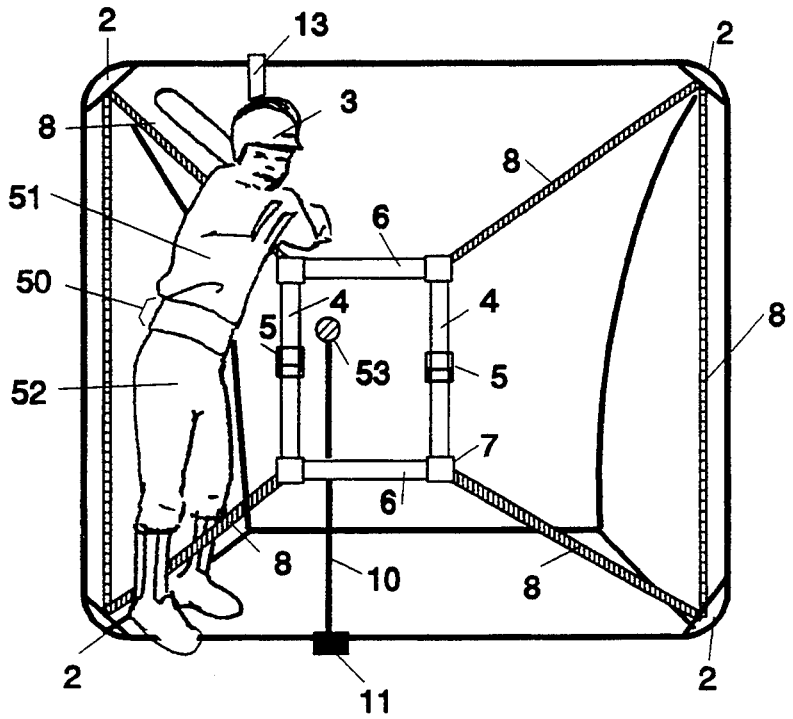
FIG. 5 shows a front view of the invention, indicating how the simulated player is adjusted in height.

Behind the strike zone frame is a catcher target (12), mounted upon a vertical shaft (10) which is attached to the lower horizontal element of the support frame (1) by a sliding collar (11). This allows the target (12) and shaft (10) to be freely moved from side to side. FIG. 5 shows the catcher target (53) offset horizontally within the strike zone frame. The catcher target (12) simulates the position of the catcher's mitt behind the strike zone. The target can be as simple as the circular target shown in FIGS. 1 (12), 4 (12) and 5 (53), or could be shaped like a catcher's mitt as shown in FIG. 3 (30). The catcher target could also be made replaceable to allow various sizes of targets. For example, in FIG. 5 the catcher target (53) is shown as smaller in diameter than in the other figures.

Preferably, the catcher target (12) promotes fine adjustment in height as well as horizontal position. This can be done as shown in FIG. 2 by mounting the target (12) on a shaft (20) which is slightly smaller in diameter than the supporting shaft (22), so that it can slide up and down within the supporting shaft (22). A collar (21) can provide adjustable friction to prevent the target from sliding freely when it is in position.

The supporting shaft (22) can be made of the same PVC material as the support frame (1), or of metal tubing, as can the inner shaft (20), if desired. Preferably, the inner shaft is a coil spring or a flexible rubber tube, so that it gives visual feedback by flexing when the ball hits it, and then springs back up to normal position. Whatever material is used, it must be sufficiently strong so as not to break when the target or shaft is hit by a thrown ball. The catcher target itself (12) can be made of plastic, wood or metal, as desired. The catcher target (12) is preferably colored in a contrasting color sufficient to be easily seen from the pitcher's position.

A simulated batter (3) is preferably provided, to allow the pitcher to visualize the strike zone in relationship with the actual batters he will face in actual games. The batter (3) is attached to the support frame (1) by straps (13), or any other convenient arrangement. The attachment points should allow some degree of adjustment of the batter's position, to allow for variations in strike zone frame location.

FIGS. 1 and 3 show how the batter can be made reversible, so that it can be mounted on either side of the support frame (1) to simulate a left-handed (FIG. 1) or right-handed (FIG. 3) batter. The simulated batter could be a simple silhouette, or could be painted with features and a uniform, as shown. It could be made of light plywood, urethane foam, or masonite, or any other material which is sufficiently strong to withstand a blow by a pitched ball.

If desired, two separate batters could be provided, one adult-sized and one child-sized, to allow the invention to serve both younger Little League and high-school or college baseball teams. Additionally, as shown in FIG. 5, the simulated batter (3) is preferably made adjustable in height by splitting him into an upper (51) and lower (52) halves, and providing a flexible or sliding middle section (50) between. A height adjustability of about 6 inches can be easily provided this way, which will allow the use of the apparatus of the invention over a wide range of conditions without need to replace the figure.

Figure 7:
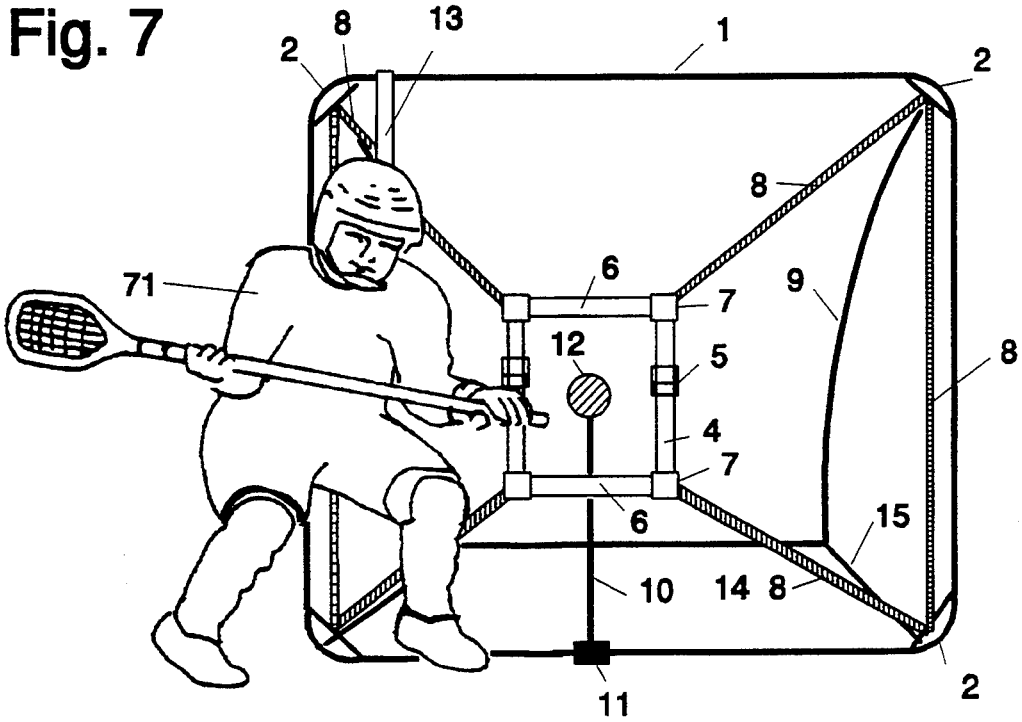
FIG. 7 shows how the invention may be varied for use with the game of lacrosse.
Figure 8:
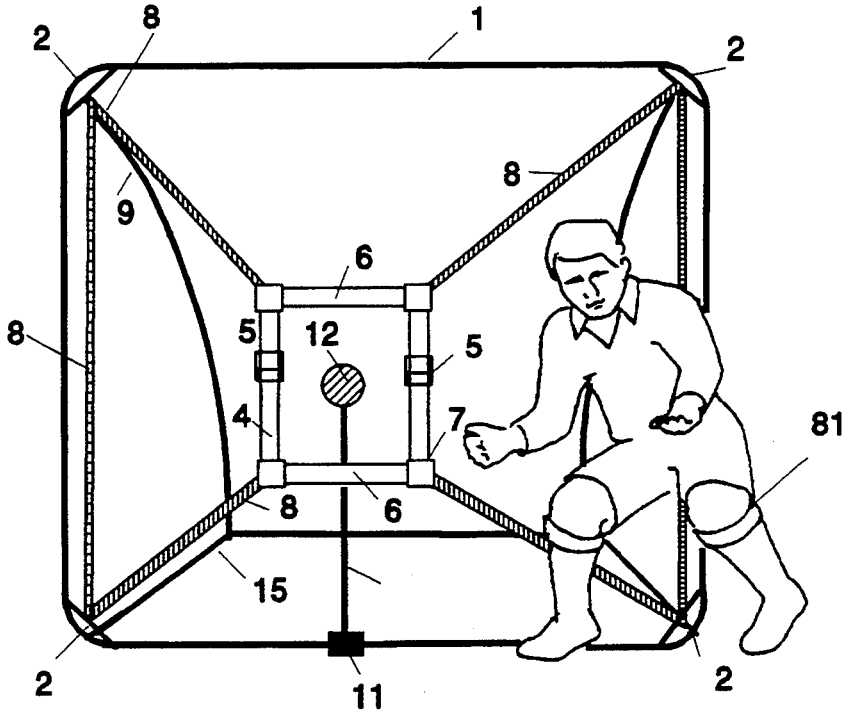
FIG. 8 shows how the invention may be varied for use with the game of soccer.

While it has been described above in terms of practice for the game of baseball, FIGS. 7 and 8 show how the invention could be varied for other games such as Lacrosse (FIG. 7) and Soccer (FIG. 8).

In FIG. 7, the batter has been replaced by a cutout of a lacrosse player (71). The rest of the invention is the same as for baseball.

For soccer (FIG. 8), a goalie cutout (81) would be used. The invention as a whole is preferably scaled up for use with the larger ball and goal areas of the game. If desired, the frame could be as large as a full soccer goal backstop (8 feet high by 24 feet wide). This would not be necessary, however, as the purpose of the invention in this game would be to train players in accuracy in kicking, and the smaller target would aid this.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A sports training apparatus comprising:
   a) a rectangular support frame;
   b) a plurality of support cords slidably attached to the support frame;
   c) a strike zone frame suspended from the support frame by the support cords, comprising a parallelogram formed of horizontal and vertical strap elements, at least the vertical strap elements being adjustable in length such that the vertical dimension of the strike zone may be freely adjusted, the strike zone frame being movable horizontally and vertically by sliding or stretching the elastic support cords.

2. The sports training apparatus of claim 1, further comprising a catcher target mounted upon a target support movably attached to the support frame, the catcher target being located behind the strike zone frame, being at least horizontally adjustable in position relative to the strike zone frame.

3. The sports training apparatus of claim 2, in which the catcher target is in the form of a simulated catcher's mitt.

4. The sports training apparatus of claim 2, in which the catcher target is in the form of a disk.

5. The sports training apparatus of claim 2, in which the target support of the catcher target is adjustable in length, such that the catcher target may be adjusted in both horizontal and vertical location relative to the strike zone frame.

6. The sports training apparatus of claim 2, in which the target support of the catcher target is at least in part made of flexible material.

7. The sports training apparatus of claim 1, further comprising a simulated game player mounted on the support frame, such that the strike zone frame represents a desired throwing area in the game represented by the player.

8. The sports training apparatus of claim 7, in which the sport is baseball, and the simulated player represents a batter.

9. The sports training apparatus of claim 7, in which the game is soccer and the simulated player represents a goalie.

10. The sports training apparatus of claim 7, in which the game is lacrosse and the simulated player represents a goal keeper.

11. The sports training apparatus of claim 7, in which the simulated player is adjustable in height.

12. The sports training apparatus of claim 1, in which the support cords are shock cords.

13. The sports training apparatus of claim 1, in which the support cords are slidably connected to cleats located at the corners of the support frame.

14. The sports training apparatus of claim 1, in which the vertical strap elements of the strike zone frame further comprise buckles, such that the length of the vertical strap elements are adjusted through the buckles.

15. The sports training apparatus of claim 7, in which the simulated player may be reversed to simulate right-handed or left-handed players.

* * * * *